US008130482B2

(12) United States Patent
Yang

(10) Patent No.: US 8,130,482 B2
(45) **Date of Patent: *Mar. 6, 2012**

(54) ELECTROMAGNETIC ACTUATING DEVICE BEING ACTUATED BY AC POWER AND HELD BY DC POWER

(76) Inventor: Tai-Her Yang, Dzan-Hwa (TW)

( * ) Notice: Subject to any disclaimer, the term of this patent is extended or adjusted under 35 U.S.C. 154(b) by 917 days.

This patent is subject to a terminal disclaimer.

(21) Appl. No.: 12/081,712

(22) Filed: Apr. 21, 2008

(65) Prior Publication Data

US 2009/0261929 A1 Oct. 22, 2009

(51) Int. Cl.
*H01H 47/00* (2006.01)

(52) U.S. Cl. ..... 361/209; 361/154; 361/189

(58) Field of Classification Search ..... 361/209, 361/154, 160, 189, 194

See application file for complete search history.

(56) References Cited

U.S. PATENT DOCUMENTS

| | | | | | |
|---|---|---|---|---|---|
| 1,621,533 | A * | 3/1927 | Grimes | 361/184 |
| 2,486,240 | A * | 10/1949 | Armstrong et al. | 361/194 |
| 3,530,311 | A * | 9/1970 | Lundin | 327/463 |
| 3,531,790 | A * | 9/1970 | Staley | 340/654 |
| 3,569,783 | A * | 3/1971 | Nicolaisen | 361/23 |
| 3,735,141 | A * | 5/1973 | Beling | 250/214 R |
| 3,919,676 | A * | 11/1975 | Bratkowski et al. | 335/179 |
| 4,654,744 | A * | 3/1987 | Okado et al. | 361/159 |
| 4,678,025 | A * | 7/1987 | Oberlander et al. | 62/325 |
| 6,845,001 | B1 * | 1/2005 | Kinbara | 361/152 |
| 2006/0221534 | A1 * | 10/2006 | Oide | 361/160 |

* cited by examiner

*Primary Examiner* — Patrick Salce
(74) *Attorney, Agent, or Firm* — Bacon & Thomas, PLLC

(57) ABSTRACT

The present invention is disclosed by that the power source device is operatively controlled by the switching device to supply AC power to excite the driving coil thereby producing larger electromagnetic effect to obtain actuating force, and after actuation, the power source device being operatively controlled by the switching device is switched to provide DC power output of lower voltage to the driving coil thereby passing smaller current to maintain excitation while required operating characteristics of the electromagnetic actuating device are still ensured.

11 Claims, 3 Drawing Sheets

ELECTROMAGNETIC ACTUATING DEVICE BEING ACTUATED BY AC POWER AND HELD BY DC POWER

BACKGROUND OF THE INVENTION (a) Field of the Invention

The present invention is mainly related to an electromagnetic actuating device with driving coils being electrified to produce electromagnetic actuating effect, wherein the power source device is operatively controlled by the switching device to supply AC power to driving coils of the electromagnetic actuating device for electrification, and after actuation, the power source device being operatively controlled by the switching device is switched to provide DC power output of lower voltage to driving coils thus holding electrification for excitation and reducing total currents passing through driving coils, while required operating characteristics of electromagnetic actuating device after electrification can still be satisfied thereby saving electric power and reducing heat loss as well as reducing noise of electromagnetic vibration.

(b) Description of the Prior Art

For conventional electromagnetic actuating devices driven by passing AC power through driving coils to produce electromagnetic actuating effects, if power supply to the coils remains unchanged during the electrification actuating and holding statuses, then short circuit rings may have to be installed on some of the electromagnetic effect absorbing surfaces in order to reduce alternated magnetic field pulsations, wherein when AC power is used for electrification holding status, as short circuit heat loss and iron core loss are produced, required current for holding electrification shall be larger thereby causing imperfections such as great overall heat loss and waste of electric power as well as noise from electromagnetic vibration.

SUMMARY OF THE INVENTION

The present invention discloses an electromagnetic actuating device being actuated by AC power and held by DC power, wherein the electromagnetic actuating device with driving coil is operatively controlled by the switching device, wherein it includes applications for normal close or normal open type electromagnetic brakes, normal close or normal open type electromagnetic clutches, normal close or normal open type electromagnetic switches, normal close or normal open type electromagnetic relays, normal close or normal open type solenoid valves, etc. as well as electromagnets, electromagnetic locks, spiral tube windings or other electromagnetic actuating devices with driving coils for electromagnetic driving effects, or operating type electromagnetic actuating devices which can be driven by driving coils or operated by numerous manual or mechanical power methods; wherein the driving coil of electromagnetic actuating device being electrically actuated by AC power input from the power source device to produce a larger electromagnetic actuating force is operatively controlled by the switching device to be switched to allow the driving coil to hold electrification by lower voltage DC power from the power source device for excitation thus reducing total current passing through the driving coil, while required operating characteristics of the electromagnetic actuating device after electrification can still be satisfied by the electromagnetic effective force (electromagnetic actuating device) thereby saving electric power and reducing heat loss as well as reducing electromagnetic vibration noise.

DESCRIPTION OF MAIN COMPONENT SYMBOLS

Figure 1:
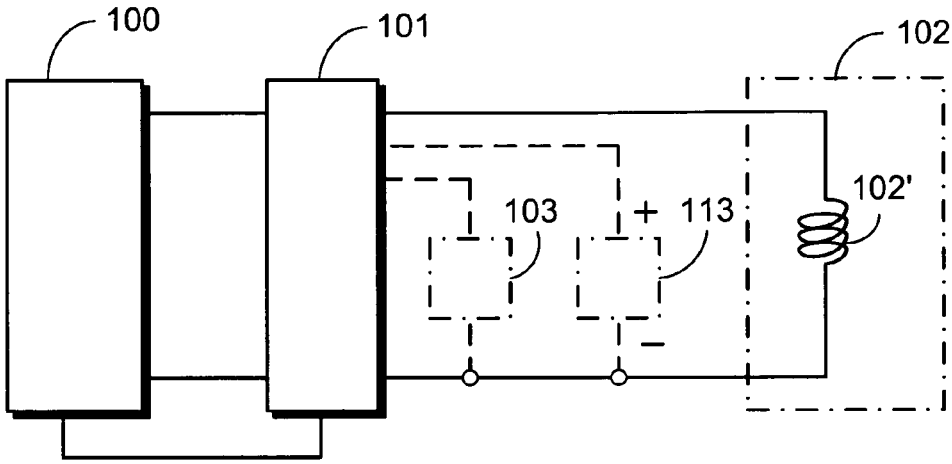
FIG. 1 is a circuit-block schematic view of an embodiment of the present invention showing the electromagnetic actuating device installed with a driving coil being electrically actuated by AC power and held by DC power.

100: Power source device
101: Switching device
102: Electromagnetic actuating device
102': Driving coil
103: AC surge absorption device
105: Position detector device
110: Current rectifier diode
111, 112: Voltage drop impedance
113: DC surge absorption device
120: Normal open contact
123: General type surge absorption device
130: Start button
140: Stop button
1*a*, 1*b*, 1*c*: Contact at the first position
2*a*, 2*b*, 2*c*: Contact at the second position
3*a*, 3*b*, 3*c*: Contact at the third position
Ia: AC excited current
Ib: DC holding current

DETAILED DESCRIPTION OF THE PREFERRED EMBODIMENTS

The present invention discloses an electromagnetic actuating device being actuated by AC power and held by DC power, wherein the electromagnetic actuating device with a driving coil is operatively controlled by the switching device, wherein it includes applications for normal close or normal open type electromagnetic brakes, normal close or normal open type electromagnetic clutches, normal close or normal open type electromagnetic switches, normal close or normal open type electromagnetic relays, normal close or normal open type solenoid valves, etc. as well as electromagnets, electromagnetic locks, spiral tube windings or other electromagnetic actuating devices with driving coils for electromagnetic driving effects, or operating type electromagnetic actuating devices which can be driven by driving coils or operated by numerous manual or mechanical power methods; wherein the driving coil of electromagnetic actuating device being electrically actuated by AC power input from the power source device to produce a larger electromagnetic actuating force is operatively controlled by the switching device to be switched to allow the driving coil to hold electrification by lower voltage DC power from the power source device for excitation thus reducing total current passing through the driving coil, while required operating characteristics of the electromagnetic actuating device after electrification can still be satisfied by the electromagnetic effective force (electromagnetic actuating device) thereby saving electric power and reducing heat loss as well as reducing electromagnetic vibration noise.

Figure 2:
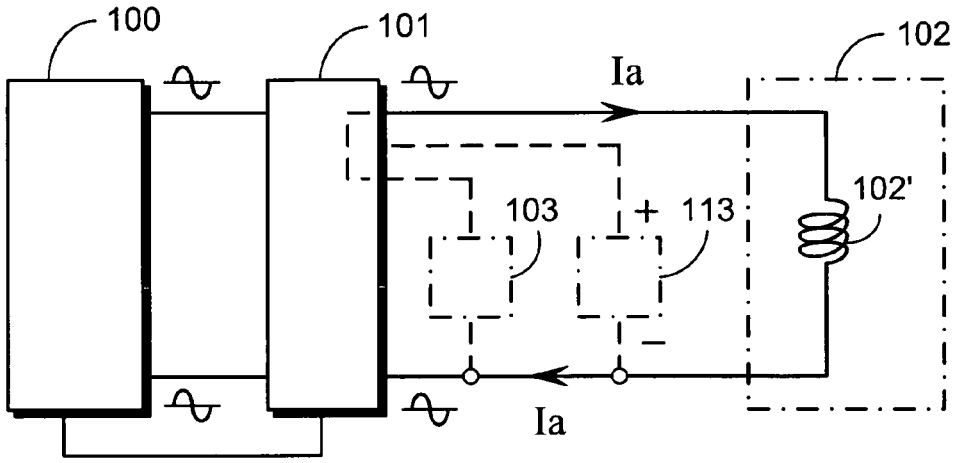
FIG. 2 is a circuit schematic view showing that AC power is supplied to the embodiment of FIG. 1 for electrification.
Figure 3:
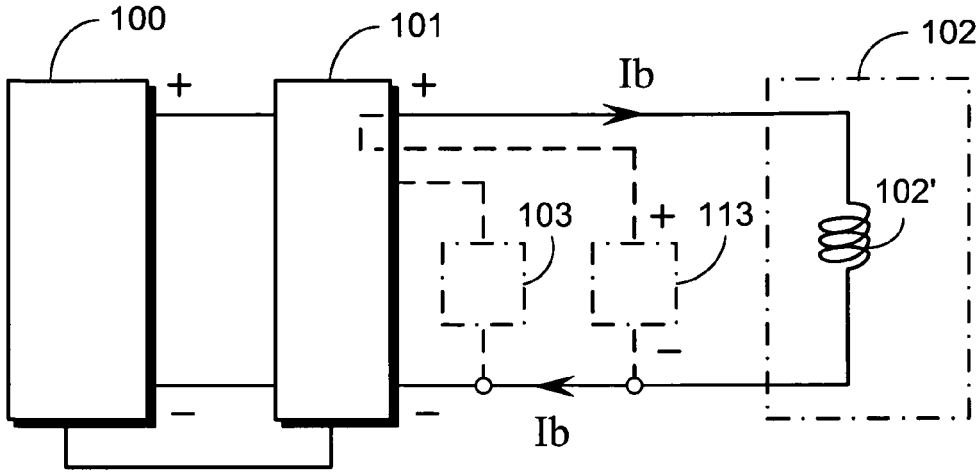
FIG. 3 is a circuit schematic view showing that lower voltage DC power is supplied to the driving coil for holding electrification in the embodiment of FIG. 1.

The embodiment of the electromagnetic actuating device with a driving coil is described in the following:

FIG. 1 is a circuit-block schematic view of an embodiment of the present invention showing the electromagnetic actuating device installed with a driving coil being electrically actuated by AC power and held by DC power, wherein it mainly includes:

A power source device (100): It is constituted by electrical machineries, electronic components, or power source supply devices containing microprocessor and relevant software with relevant power supply functions as well as voltage and current control functions to receive DC or AC power supply and to be operatively controlled by the switching device (101) to provide AC power output or DC power output of lower voltage, or DC power output of semi-wave or full waved or chopped wave, etc;

A switching device (101): It is constituted by an electromechanical switch, an electric relay, an electromagnetic switch or a solid state switching device, etc operable by the manual, mechanical, fluid or electrical power being operated by the manual, mechanical, fluid or electrical power is through supplying AC or DC power to the driving coil (102') of the electromagnetic actuating device (102) to provide a switching function for electrification and power cut-off, or it is through the switchover operation by the switching device (101) to allow the power source device (100) to supply AC power to the driving coil (102') of the electromagnetic actuating device thereby passing AC excited current (Ia) for electrification, FIG. 2 is a circuit schematic view showing that AC power is supplied to the embodiment of FIG. 1 for electrification, wherein the driving coil (102') being actuated for excitation by AC power input is switchingly operatively controlled by the switching device (101) to allow DC power output of lower voltage from the power source device (100) to be supplied to the driving coil (102') thus allowing DC excited current (Ib) at lower voltage to pass through the driving coil (102') thereby holding electrification for excitation. FIG. 3 is a circuit schematic view showing that lower voltage DC power is supplied to the driving coil for holding electrification in the embodiment of FIG. 1, wherein when the lower voltage DC power is supplied to the driving coil (102') for holding electrification, total current on the driving coil (102') is reduced, while operating characteristics of the electrified electromagnetic actuating device is still ensured by the electromagnetic effective force, thereby saving electric power and reducing heat generation in the electromagnetic actuating device.

For the electromagnetic actuating device being actuated in AC power and held by DC power, the driving coil (102') installed in the electromagnetic actuating device (102) being electrified by AC power input is operatively controlled by the switching device (101) to switch AC power output from the power source device (100) to DC power output of lower voltage for supplying to the driving coil (102') thereby holding electrification for excitation, wherein the switching methods include:

(1) Power supply from the power source device (100) to the driving coil (102') being operatively controlled by a manual-sequential operating switching device (101) includes actuation for excitation by AC power input being switched to hold electrification for excitation by lower voltage DC power; or (2) Power supply from the power source device (100) to the driving coil (102') being operatively controlled by the switching device (101) with a time delay function includes actuation for excitation by AC power input being switched to hold electrification for excitation by lower voltage DC power after a time delay; or (3) By detecting current values passing through the switching device (101) to the driving coil (102'), when AC power of higher voltage from power source device (100) is supplied to the driving coil (102') installed in the electromagnetic actuating device (102) to electrically actuate excited current value □ the setting current value, or □ the status of setting current value exceeding over the setting time, the switching device (101) is driven to operatively control power supply from the power source device (100) to the driving coil (102') to be switched to supply lower voltage DC power to the driving coil (102') thereby holding electrification for excitation; or (4) The switching device (101) is operatively controlled by two or more than two methods of the above said (1)(2)(3);

The electromagnetic actuating devices (102): It is a device installed with an AC or DC powered driving coil (102') including conventional normal close or normal open type electromagnetic brakes, normal close or normal open type electromagnetic clutches, normal close or normal open type electromagnetic switches, normal close or normal open type electromagnetic relays, normal close or normal open type solenoid valves, etc. as well as electromagnets, electromagnetic locks, spiral tube windings or other electromagnetic actuating devices with driving coils for electromagnetic driving effects, or operating type electromagnetic actuating devices which can be driven by driving coils or operated by numerous manual or mechanical power methods; wherein the AC power input supplied from the power source device (100) being operatively controlled by the switching device (101) to electrically actuate the driving coil (102') of the electromagnetic actuating device (102) for excitation is further switched after actuation to allow the power source device (100) to supply lower voltage DC power to the driving coil (102') thus holding electrification for excitation thereby saving electric power and reducing heat generation; wherein when lower voltage DC power input being supplied to the driving coil (102') of the electromagnetic actuating device (102) thus holding electrification for excitation, required operating characteristics of the electromagnetic actuating device in electrification status are still satisfied by the electromagnetic effective force thereby saving electric power, reducing heat loss and reducing electromagnetic vibration noise;

The AC surge absorption device (103), DC surge absorption device (113), general type surge absorption device (123): The AC surge absorption device (103), DC surge absorption device (113) or general type surge absorption device (123) being optionally installed to parallel connect with the driving coil based on input power types to the electromagnetic actuating device (102) is used to help absorbing the produced inductance of counter-electric potential in the driving coil (102') when the driving coil (102') is operated by the switching device (101) to open or close, or to receive AC power for electrification, or to be switched to receive lower voltage DC power for holding excitation, wherein AC power input to the driving coil (102') or the relative switchover to lower voltage DC power can be respectively matchingly optionally connected with the AC surge absorption device (103), DC surge absorption device (113), or general type surge absorption device (123); wherein the surge absorption device is optionally constituted by the following: (1) When the driving coil (102') is powered by AC power, the AC surge absorption device (103) is installed, such as that it can be constituted by a bipolar solid state varistor, or constituted by at least two kinds of components of the resistors, inductors, bipolar capacitors, etc. in series connection, parallel connection, or series-parallel connection, or constituted by the bipolar capacitor alone, or constituted by other conventional AC surge absorption circuit devices; (2) When the driving coil (102') is powered by DC power, the DC surge absorption device (113) is installed, such as that it can be constituted by reverse polarity diodes in parallel connection to appear a flywheel diode with energy storage effect, or constituted by at least two kinds of components of the resistors, inductors, uni-polar or bipolar capacitors in series connection, parallel connection, or series-parallel connection, or constituted by the uni-polar or bipolar capacitor alone, or constituted by the solid state varistor or other conventional DC surge absorption devices; (3) When the driving coil (102') is powered by mixture of AC and DC power, the general type surge absorption device (123) capable of absorbing either AC surge power or DC surge power is installed, such as that it can be constituted by at least two kinds of components of the resistors, inductors or bipolar capacitors in series connection, parallel connection, or series-parallel connection, or constituted by the bipolar capacitor alone, or constituted by bipolar solid state varistor or other conventional general type surge absorption devices; wherein this device can be optionally installed or not installed as required.

Figure 4:
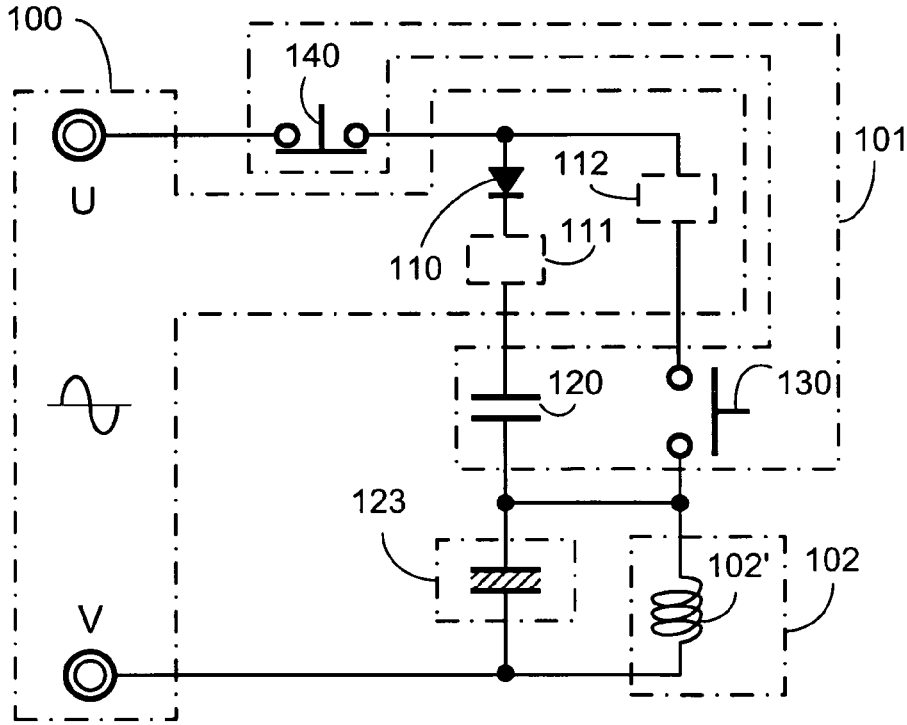
FIG. 4 is the first circuit example showing that the present invention being applied for single phase AC power source is actuated by AC power for excitation and held electrification for excitation by lower voltage DC power.

The electromagnetic actuating device being actuated by AC power and held by DC power has numerous circuit applications, wherein two examples are described in the following:

FIG. 4 is the first circuit example showing that the present invention being applied for single phase AC power source is actuated by AC power for excitation and held electrification for excitation by lower voltage DC power.

In the application example shown in the FIG. 4, the AC power source and the current rectifier diode constitute the power source device (100) capable of providing AC power or lower voltage DC power output, wherein the switching device (101) is constituted by a start button (130), a stop button (140), and a normal open contact (120) driven by the driving coil (102') of the electromagnetic actuating device (102) to operatively control the power supplied by the power source device (100); further, the bipolar capacitor with general type surge absorption device function (123) is parallel connected with the driving coil (102'), and one end of the driving coil (102') is connected to the V terminal of the AC power source, while the other end is connected to the loading end of the normal open contact (120) and directly connected to the loading end of the start button (130), or is first optionally series connected with a voltage drop impedance (112) as required and is then connected to the loading end of the start button (130); in addition, the U terminal of power source device (100) is connected to the power source end of the start button (130) via the AC power output end of the stop button (140), and is connected to the power source end of the normal open contact (120) via the lower voltage DC output end of the current rectifier diode (110), or the output end of the current rectifier diode (110) is first optionally series connected with an impedance (111) as required, and is then connected to the power source end of the normal open contact (120); wherein the circuit functions are:

When the start button (130) is pressed to close, AC power is through the start button (130) to electrify the driving coil (102') for excitation thereby closing the normal open contact (120); when the start button (130) is released for recovery to open circuit, lower voltage DC power output is supplied by the power source (100) via the current rectifier diode (110) thereby allowing the driving coil (102') to continue holding electrification for excitation, while surge and pulsation power are absorbed by the general type surge absorption device (123);

When the stop button (140) is pressed, power supply from the power source device (100) to the driving coil (102') is cut off thereby allowing the electromagnetic actuating device (102) to recover back to waiting status.

Figure 5:
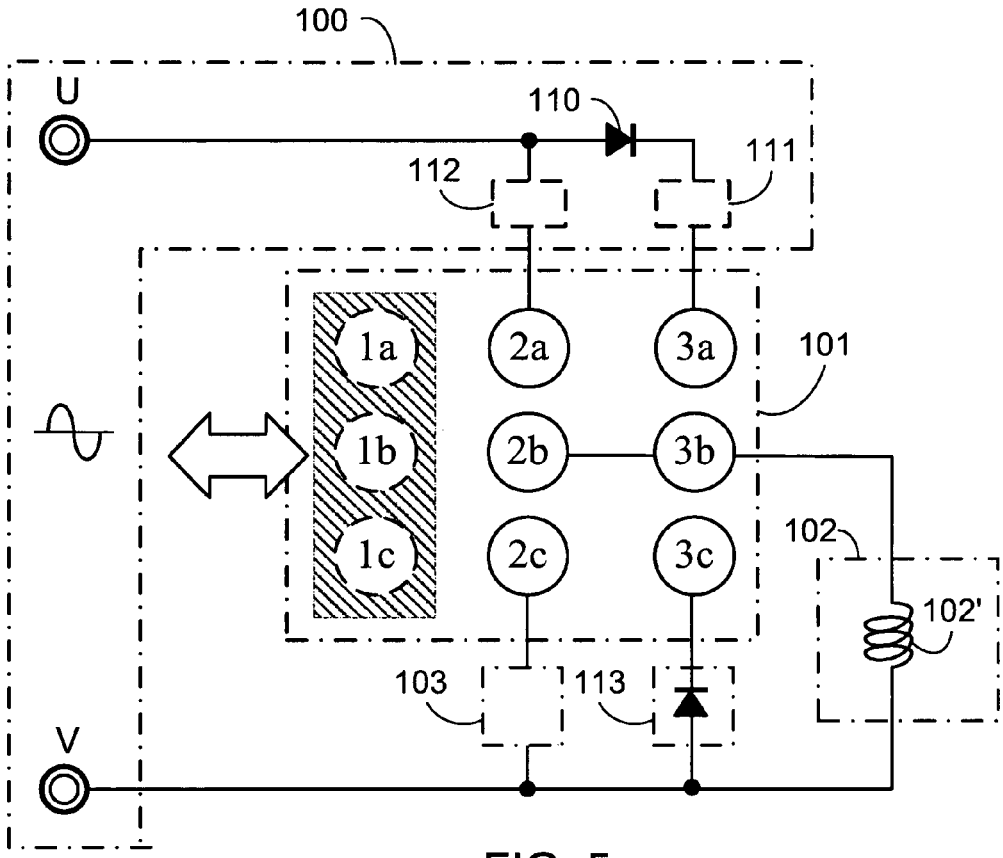
FIG. 5 is the second circuit example showing that the present invention being applied for single phase AC power source is actuated by AC power for excitation and held electrification for excitation by lower voltage DC power.

FIG. 5 is the second circuit example showing that the present invention being applied for single phase AC power source is actuated by AC power for excitation and held electrification for excitation by lower voltage DC power.

In the application example shown in the FIG. 5, the AC power source and the current rectifier diode constitute the power source device (100) capable of providing AC power or lower voltage DC power output, wherein the switching device (101) being constituted by a three-way, three position switch to operatively control the power supplied by the power source device (100) has a sliding conducting plate capable of translation in three positions relative to three way short circuit contacts; wherein the first position is OFF position for waiting use, and the installed (1*a*), (1*b*), (1*c*) contacts can also be empty without installing contacts, the contact (2*a*) at the second position is directly connected to the terminal U of AC power source of the power source device (100), or is first optionally series connected with a voltage drop impedance (112) as required and is then connected to the terminal U of AC power source of the power source device (100); the terminal U of AC power source of the power source device (100) can be directly forward series connected with the current rectifier diode (110) to further connect with a contact (3*a*) at the third position of the three way, three positions switch, or can be forward series connected a current rectifier diode (110) and then optionally series connected with a voltage drop impedance (111) to further connect with a contact (3*a*) at the third position of the three way, three positions switch; the contact (2*b*) at the second position and the contact (3*b*) at the third position are connected and further connected to the driving coil (102') of the electromagnetic actuating device (102), while another end of the driving coil (102') is connected to the terminal V of power source;

One end of the AC surge absorption device is connected to a contact (2*c*) at the second position, while another end is connected to the terminal V of power source;

The positive end of the DC surge absorption device (113) is constituted by a flywheel diode for connection to the contact (3*c*) at the third position, while the negative end thereof is connected to the terminal V of power source;

When the switching device (101) constituted by the three way, three positions switch is at the first position, it is at OFF status for waiting;

When the switching device (101) constituted by the three way, three positions switch is at the second position, the driving coil (102') of electromagnetic actuating device (102) is electrically actuated by AC power output from the power source device (100) for excitation;

When the switching device (101) constituted by the three way, three positions switch is at the third position, the driving coil (102') of electromagnetic actuating device (102) is held electrification by lower voltage DC power output from the power source device (100) for excitation.

Figure 6:
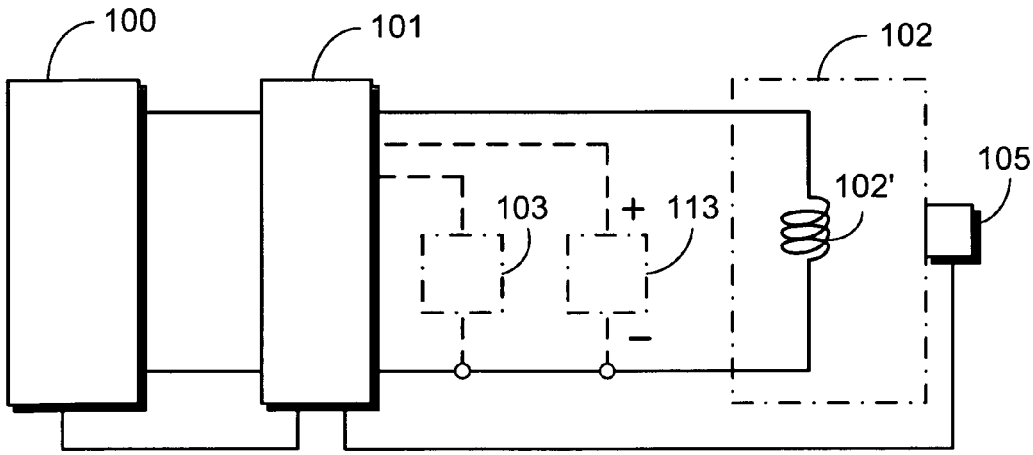
FIG. 6 is a circuit-block schematic view showing that the electromagnetic actuating device is installed with a position detector device to operatively control the power input to the driving coil for excitation.

For the electromagnetic actuating device being actuated by AC power and held by DC power of the present invention, the driving coil (102') of electromagnetic actuating device (102) being electrically actuated by AC power for excitation is switched to allow the driving coil (102') to hold electrification by lower voltage DC power for excitation, and further as shown in FIG. 6 which is a circuit-block schematic view showing that the electromagnetic actuating device is installed with a position detector device to operatively control the power input to the driving coil for excitation; wherein the position detector device (105) is installed at a stable position after relative actuation between the rotor and the stator of the electromagnetic actuating device or at a selected position in the stroke of actuation, so that the driving coil (102') of electromagnetic actuating device (102) being electrified by AC power input to a stable position or a selected position in the stroke of actuation is through the position detector device (105) to directly switch the power source device (100) to allow the driving coil (102') to hold electrification by lower voltage DC power for excitation; or the switching device (101) is operatively controlled by said position detector device (105) to allow the driving coil (102') of electromagnetic actuating device (102) to be driven by AC power input to a stable position or a selected position in the stroke of actuation thereby allowing the position detector device (105) to operatively control the switching device (101) to be further switched to allow the driving coil (102') to hold electrification by lower voltage DC power from the power source device (100) for excitation;

The position detector device (105) can be constituted by pressure sensing type electromechanical switching devices or pressure-actuating spring leaf type switches, or can be constituted by optical, electromagnetic inducing type, capacitive inducing type or other conventional position sensing devices, wherein this device can be optionally installed or not installed as required.

As summarized from the above descriptions, for the electromagnetic actuating device being actuated by AC power and held by DC power of the present invention, the power source device (100) is operatively controlled by the switching device (101) to supply AC power to the driving coil (102') of electromagnetic actuating device (102) for electrifying the driving coil (102') thereby allowing the electromagnetic actuating device to produce larger electromagnetic effective force, wherein after actuation, the power source device (100) is operatively controlled by the switching device (101) to be switched to provide lower voltage DC power output for supply to the driving coil (102') thus holding electrification for excitation thereby reducing total current passing through the driving coil, while required operating characteristics of the electromagnetic actuating device in electrification by the electromagnetic effective force can still be satisfied thereby saving electric power and reducing heat loss as well as reducing electromagnetic vibration noise.

The invention claimed is:

1. An electromagnetic actuating device being actuated by AC power and held by DC power, comprising:

a power source device;

a switching device configured to control said power source device to switch from said AC power output to said DC power output, to allow DC power output of lower voltage from the power source device to be supplied to the driving coil thus allowing DC excited current (Ib) at lower voltage to pass through the driving coil thereby holding electrification for excitation, wherein when the lower voltage DC power is supplied to the driving coil for holding electrification, total current on the driving coil is reduced, while operating characteristics of the electrified electromagnetic actuating device is still ensured by the electromagnetic effective force;

wherein a driving coil of electromagnetic actuating device being electrically actuated by AC power input from the power source device to produce a larger electromagnetic actuating force is operatively controlled by the switching device to be switched to allow the driving coil to hold electrification by lower voltage DC power from the power source device for excitation thus reducing total current passing through the driving coil.

2. The electromagnetic actuating device being actuated by AC power and held by DC power as claimed in claim 1, wherein the power supply from the power source device to the driving coil is operatively controlled by a manual-sequential operating switching device includes actuation for excitation by AC power input being switched to hold electrification for excitation by lower voltage DC power; or the power supply from the power source device to the driving coil is operatively controlled by the switching device with a time delay function includes actuation for excitation by AC power input being switched to hold electrification for excitation by lower voltage DC power after a time delay.

3. The electromagnetic actuating device being actuated by AC power and held by DC power as claimed in claim 1, further comprising a position detector device installed at a stable position after relative actuation between the rotor and the stator of the electromagnetic actuating device or at a selected position in the stroke of actuation, so that the driving coil of electromagnetic actuating device being electrified by AC power input to a stable position or a selected position in the stroke of actuation is through the position detector device to directly switch the power source device to allow the driving coil to hold electrification by lower voltage DC power for excitation; or the switching device is operatively controlled by said position detector device to allow the driving coil of electromagnetic actuating device to be driven by AC power input to a stable position or a selected position in the stroke of actuation thereby allowing the position detector device to operatively control the switching device to be further switched to allow the driving coil to hold electrification by lower voltage DC power from the power source device for excitation.

4. The electromagnetic actuating device being actuated by AC power and held by DC power as claimed in claim 1, further comprising:

a surge absorption device installed to parallel connect with the driving coil based on input power types to the electromagnetic actuating device, the surge absorption device being used to absorb a produced inductance of counter-electric potential in the driving coil when the driving coil is operated by the switching device to open or close, or to receive AC power for electrification, or to be switched to receive lower voltage DC power for holding excitation, wherein AC power input to the driving coil or the relative switchover to lower voltage DC power can be respectively matchingly connected with the surge absorption device.

5. An electromagnetic actuating device being actuated by AC power and held by DC power as claimed in claim 1, wherein power source device comprises an AC power source and a current rectifier diode configured to selectively provide AC power and lower voltage DC power output, wherein the switching device comprises a start button, a stop button, and a normal open contact driven by the driving coil of the electromagnetic actuating device to operatively control the power supplied by the power source device;

wherein the bipolar capacitor with general type surge absorption device function is parallel connected with the driving coil, and one end of the driving coil is connected to the V terminal of the AC power source, while the other end is connected to the loading end of the normal open contact and directly connected to the loading end of the start button, or is first optionally series connected with a voltage drop impedance as required and is then connected to the loading end of the start button;

wherein the U terminal of power source device is connected to the power source end of the start button via the AC power output end of the stop button, and is connected to the power source end of the normal open contact via the lower voltage DC output end of the current rectifier diode, or the output end of the current rectifier diode is first optionally series connected with an impedance as required, and is then connected to the power source end of the normal open contact; wherein the circuit functions are:

when the start button is pressed to close, AC power is through the start button to electrify the driving coil for excitation thereby closing the normal open contact; when the start button is released for recovery to open circuit, lower voltage DC power output is supplied by the power source via the current rectifier diode thereby allowing the driving coil to continue holding electrification for excitation, while surge and pulsation power are absorbed by the general type surge absorption device;

when the stop button is pressed, power supply from the power source device to the driving coil is cut off thereby allowing the electromagnetic actuating device to recover back to waiting status.

6. An electromagnetic actuating device being actuated by AC power and held by DC power as claimed in claim 1, wherein the power source device comprises an AC power source and a current rectifier diode configured to selectively provide AC power and lower voltage DC power output, wherein the switching device comprises a three-way, three position switch to operatively control the power supplied by the power source device, the three-way, three position switch having a sliding conducting plate capable of translation in three positions relative to three way short circuit contacts; wherein the first position is OFF position for waiting use, and the installed (1*a*), (1*b*), (1*c*) contacts can also be empty without installing contacts, the contact (2*a*) at the second position is directly connected to the terminal U of AC power source of the power source device, or is first optionally series connected with a voltage drop impedance as required and is then connected to the terminal U of AC power source of the power source device; the terminal U of AC power source of the power source device can be directly forward series connected with the current rectifier diode to further connect with a contact (3*a*) at the third position of the three way, three positions switch, or can be forward series connected the current rectifier diode and then optionally series connected with the voltage drop impedance to further connect with the contact (3*a*) at the third position of the three way, three positions switch; contact (2*b*) at the second position and the contact (3*b*) at the third position are connected and further connected to the driving coil of the electromagnetic actuating device, while another end of the driving coil is connected to the terminal V of power source;

one end of the AC surge absorption device is connected to a contact (2*c*) at the second position, while another end is connected to the terminal V of power source;

a positive end of the DC surge absorption device comprises a flywheel diode for connection to the contact (3*c*) at the third position, while the negative end thereof is connected to the terminal V of power source;

wherein when the three way, three positions switch is at the first position, it is at OFF status for waiting; when the three way, three positions switch is at the second position, the driving coil of electromagnetic actuating device is electrically actuated by AC power output from the power source device for excitation; and when the three way, three positions switch is at the third position, the driving coil of electromagnetic actuating device is held electrification by lower voltage DC power output from power source device for excitation.

7. The electromagnetic actuating device being actuated by AC power and held by DC power as claimed in claim 6, wherein it includes applications for normal close or normal open type electromagnetic brakes, normal close or normal open type electromagnetic clutches, normal close or normal open type electromagnetic switches, normal close or normal open type electromagnetic relays, normal close or normal open type solenoid valves, etc. as well as electromagnets, electromagnetic locks, spiral tube windings or other electromagnetic actuating devices with driving coils for electromagnetic driving effects, or operating type electromagnetic actuating devices which can be driven by driving coils or operated by numerous manual or mechanical power methods.

8. The electromagnetic actuating device being actuated by AC power and held by DC power as claimed in claim 1, wherein the switching device is configured to detect current values passing through the switching device to the driving coil, such that when AC power of higher voltage from power source device is supplied to the driving coil installed in the electromagnetic actuating device to electrically actuate excited current value≧the setting current value, or≧the status of setting current value exceeding over the setting time, the switching device is driven to operatively control power supply from the power source device to the driving coil to be switched to supply lower voltage DC power to the driving coil thereby holding electrification for excitation.

9. The electromagnetic actuating device being actuated by AC power and held by DC power as claimed in claim 4, wherein the surge absorption device is an AC surge absorption device.

10. The electromagnetic actuating device being actuated by AC power and held by DC power as claimed in claim 4, wherein the surge absorption device is a DC surge absorption device.

11. The electromagnetic actuating device being actuated by AC power and held by DC power as claimed in claim 4, wherein the surge absorption device is a general type surge absorption device.

* * * * *